US009962894B1

(12) United States Patent
McDonald

(10) Patent No.: US 9,962,894 B1
(45) Date of Patent: May 8, 2018

(54) PRESS TO FLATTEN BAMBOO STALKS

(71) Applicant: William D McDonald, Santa Rosa, CA (US)

(72) Inventor: William D McDonald, Santa Rosa, CA (US)

(73) Assignee: Bamcore LLC, Windsor, CA (US)

( * ) Notice: Subject to any disclaimer, the term of this patent is extended or adjusted under 35 U.S.C. 154(b) by 231 days.

(21) Appl. No.: 14/936,006

(22) Filed: Nov. 9, 2015

(51) Int. Cl.

| | |
|---|---|
| ***B30B 9/00*** | (2006.01) |
| ***B30B 15/06*** | (2006.01) |
| ***B27J 1/00*** | (2006.01) |
| *B27N 1/00* | (2006.01) |

(52) U.S. Cl.
CPC ..... *B30B 9/00* (2013.01); *B27J 1/00* (2013.01); *B30B 15/06* (2013.01); *B27N 1/00* (2013.01)

(58) Field of Classification Search
CPC ... B27J 1/00; B27N 3/04; B30B 15/06; B30B 9/00; B27M 3/00; B27M 1/02
See application file for complete search history.

(56) References Cited

U.S. PATENT DOCUMENTS

| | | | | |
|---|---|---|---|---|
| 1,688,569 | A * | 10/1928 | Wensel | B27M 3/22 144/333 |
| 2,747,500 | A * | 5/1956 | Weatherly | E04G 21/066 100/217 |
| 5,881,786 | A | 3/1999 | Wilderman et al. | |
| 5,976,644 | A | 11/1999 | Sanaee et al. | |
| 6,192,949 | B1 | 2/2001 | Nien | |
| 7,473,455 | B2 | 1/2009 | Wang et al. | |
| 8,173,236 | B1 | 5/2012 | McDonald | |
| 8,354,161 | B2 * | 1/2013 | Lin | B27J 1/00 428/156 |
| 2006/0060263 | A1 * | 3/2006 | Inoue | B27J 1/00 144/353 |
| 2008/0023868 | A1 | 1/2008 | Slaven et al. | |
| 2008/0078469 | A1 * | 4/2008 | Lee | B27J 1/00 144/329 |

(Continued)

FOREIGN PATENT DOCUMENTS

| | | |
|---|---|---|
| JP | 01294003 | * 11/1989 |
| JP | 09070805 | * 3/1997 |

(Continued)

*Primary Examiner* — R. K. Arundale
*Assistant Examiner* — Mohammad Yusuf
(74) *Attorney, Agent, or Firm* — Steven A. Nielsen; www.NielsenPatents.com

(57) ABSTRACT

A disclosed press 100 may flatten halved bamboo stalks or other workpieces without loss of volume or splintering. In a first mechanical movement executed by a pushrod drive train 300, a plurality of spreader bar assemblies 370 press upon the centerline of a workpiece such that the workpiece does not move off of a work surface but is yet not over crushed. Each spreader bar assembly may comprise two spreader bars 350 hingedly attached to a pushrod 345. The lower end of the pushrod and proximal ends 363 of the spreader bars pin down the workpiece. In a second mechanical movement executed by a crusher bar drive train 400, the distal ends of the spreader bars are moved outwardly and spread apart the curved walls of the workpiece. In the last phases of a second movement, planar track plates 440 press downwardly upon the workpiece.

13 Claims, 18 Drawing Sheets

(56) References Cited

U.S. PATENT DOCUMENTS

| | | | | |
|---|---|---|---|---|
| 2009/0250141 | A1* | 10/2009 | Wang | B27J 1/00 144/333 |
| 2013/0108857 | A1 | 5/2013 | Zang et al. | |
| 2013/0219826 | A1 | 8/2013 | Kracht et al. | |

FOREIGN PATENT DOCUMENTS

| | | | |
|---|---|---|---|
| JP | 2006027095 | * | 2/2006 |
| JP | 2007021793 | * | 2/2007 |

* cited by examiner

PRESS TO FLATTEN BAMBOO STALKS

BACKGROUND OF THE INVENTION

(1) Field of the Invention

The invention generally relates to presses for flattening curved wood products. More particularly, the invention relates to the use of a press having a spreader bar assembly to retain and to spread apart the curved vertical walls of a halved bamboo stalk.

(2) Description of the Related Art

Much of the related art side steps the difficult process of flattening a halved bamboo stalk. For example, U.S. Pat. No. 5,976,644 granted to Sanaee et al creates a laminate bamboo product by carving flat strips from within a curved halved stalk as illustrated in FIG. 10 of Sanaee. Such a practice wastes a great majority of the stalk. U.S. Pat. No. 7,473,455 granted to Want et al on Jan. 6, 2009 obtains flat, but paper thin lengths of bamboo by use of "thin slices" as illustrated in FIG. 1 of Wang. Such thin slices are then processed by use of press mold device. The Wang system requires an inordinate amount of cutting and reconfiguration of bamboo "thin slices."

While the prior art extolls the versatility and strength of bamboo products, the prior art fails to provide effective means of flattening or softening a halved bamboo stalk. Thus, there is need in the art for the disclosed embodiments.

BRIEF SUMMARY OF THE INVENTION

The disclosed embodiments overcome shortfalls in the related art by presenting an unobvious and unique combination, configuration and use of components to efficiently and quickly flatten halved bamboo stalks and similar work pieces. While the strong material properties of bamboo are useful for building homes and other significant structures, the material strength of bamboo presents a challenge in flattening an entire halved bamboo stalk. The disclosed embodiments present an advantage over the prior art that goes to great lengths cut up bamboo stalks to obtain flattened or flat pieces of bamboo.

Due to the strong material strength of bamboo and the inherent structural strength of a halved stalk, there is a significant challenge in retaining a bamboo stalk upon a work surface during a pressing process. Without means of retention, a halved bamboo stalk or similar workpiece will move horizontally during pressing, preventing an even flattening or scoring of the stalk. Moreover, a flat pressing upon the turned up or near vertical sides of a halved stalk sometimes causes the stalk to break apart or score unevenly. A simple flat pressing also requires an inordinate amount of downward force, creating a risk of breaking the stalk into uneven pieces. A simple flat press of a halved stalk creates a risk of personal injury as extraordinary forces are needed in the first few inches of movement to deform the strong circular bamboo walls, with such force sometimes causing dislodging of the workpiece and sometimes shattering of the workpiece after the circular walls have deflected.

The disclosed embodiments solve these and other problems by presenting a two part retention and pressing process. In a first mechanical movement or position, a plurality of a spreader bar assemblies press a plurality of retracted spreader bars upon a longitudinal center line of a halved bamboo stalk or similar workpiece. This first mechanical movement may be achieved by use of a hydraulic system or other source of movement. This first mechanical movement may occur prior to a second movement. The vertical aspect of this first mechanical movement may finish prior to a second movement.

The first mechanical movement overcomes shortfalls in the art by retaining the workpiece during the pressing process and by facilitating longitudinal break lines or score lines within the workpiece during a second and sometimes separate movement. In a first mechanical movement, each spreader bar assembly may comprise a vertical pushrod hingedly attached to two spreader bars, with the two spreader bars initially in a near vertical position. In a first movement, the proximal ends of the spreader bars and the lower end of the push rod may pin down the workpiece while distal or outer ends of the spreader bars are confined with components of the second movement. During a second movement, the distal ends of the spreader bars may move outwardly spreading apart the curved walls of the workpiece. The spreading of the distal ends of the spreader bars may be controlled by the second movement and components of the second movement. The near the conclusion of the second movement, a planar surface of the second movement may flatten the walls of the workpiece, with such walls previously spread apart by the spreader bars.

A subsequent or second mechanical movement may employ vertical forces that are independent of the first movement. A second movement may employ an upper crush bar and related components to retain distal ends of the spreader bars such that the spreader bars move outwardly to spread apart the workpiece while the upper crush bar and related components apply a downward planar force upon the workpiece. This second movement overcomes shortfalls in the art by urging the lateral movement of the distal ends of the spreader bars to smoothly move the near vertical walls of the workpiece to a more horizontal position while the proximal ends of the spreader bars continue to hold down the workpiece.

A mechanical advantage is obtained by the upper crush bar containment of the distal ends of the spreader bars as the proximal ends of the spreader bars stay in place upon the center of the workpiece and the distal ends of the spreader bars move outwardly in concert with the downward movement of the crush bar components. Thus, the outward or lateral movement of the spreader bars place the workpiece in a more flattened position, ready to accept the planar horizontal flattening of the upper crush bar and related components.

The seamless retention of the workpiece with the lateral expansion of the workpiece is enhanced by the first movement and related components placing proximal spreader bar ends in the center of the workpiece and by the separate second movement and related components laterally urging the distal ends of the spreader bars against the inside surfaces of the near vertical circular walls of the workpiece. Disclosed embodiments overcome shortfalls in the art by providing a compact and efficient industrial design by use of a track system attached to the upper crush bar to retain and move the distal spreader bar ends by use of the downward force of the second movement components.

Within disclosed embodiments, the compact and efficient integration of components is achieved by the first movement and first movement components moving the proximal spreader bar ends only while the second movement and second movement components move the distal spreader bar ends only. Thus, the pushrod and proximal spreader bar ends maintain a constant retention pressure upon the longitudinal center line of the workpiece so as to firmly retain the workpiece without shattering the workpiece. The second movement and related components may even have a separate source of downward force so as to not disturb the initial retention of the workpiece. In various disclosed embodiments, mechanical efficiency and compact design is achieved by the overlapping integration of the components of the first and second movements. For example, the pushrod of the first movement may pass through a void in the upper crusher bar or other components of the second movement.

In various disclosed embodiments the components of the first movement may be referred to as components of the pushrod drive train while second movement components may be referred to as the crusher bar drive train. A spreader bar assembly may include two spreader bars pivotally attached to a pushrod.

Disclosed embodiments provide advantages over the prior art by producing a conditioned, scored, flattened or near flatted bamboo stalk that is ready for further processing as a whole. Disclosed embodiments produce bamboo stalks that have uniform and longitudinal score lines or break lines without loss of volume or excessive breakage of the workpiece. A conditioned workpiece is ready lamination and other traditional processing to produce exceptionally strong building materials.

REFERENCE NUMERALS IN THE DRAWINGS

Figure 1:
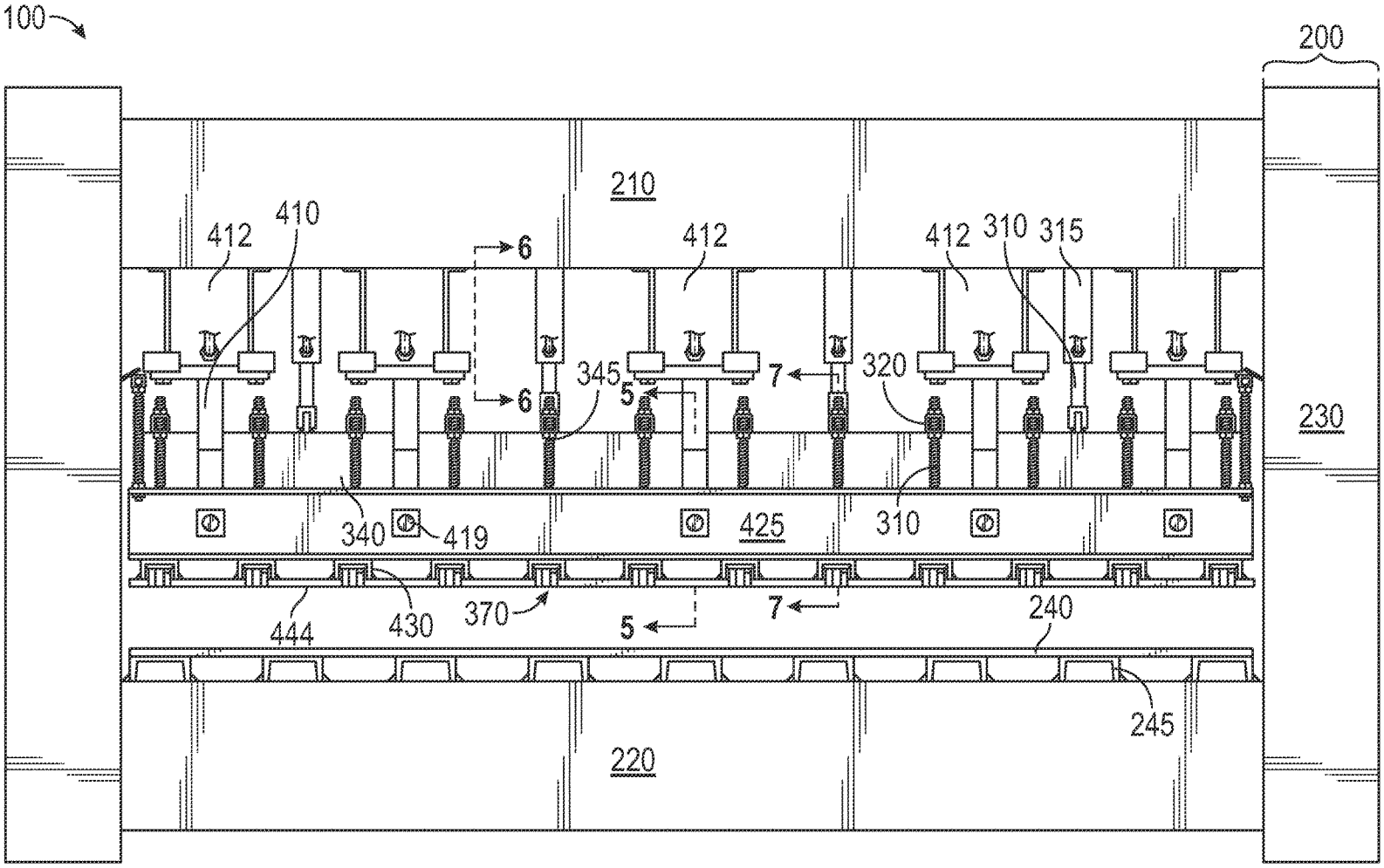
FIG. 1 depicts a side elevational view of a disclosed machine

100 disclosed embodiment in general
200 support frame
210 upper horizontal member of support frame 200
220 lower horizontal member of support frame 200
230 vertical member of support frame 200
235 lower horizontal end member of support frame 200
237 upper horizontal end member of support frame 200 2
240 lower crush surface
245 support channels below lower crush surface 240
300 pushrod drive train
310 rod of push rod hydraulic system of pushrod drive train 300
311 connection component between rod 310 and cross bar 320
312 hinge pin of connection component 311 and rod 310
315 barrel of push rod hydraulic system of pushrod drive train 300
320 cross bar of pushrod drive train 300
340 main rail of pushrod drive train 300
345 pushrod of pushrod drive drain 300
347 flat distal section of pushrod 345
350 spreader bar
352 cambered edge of spreader bar
353 normal edge of spreader bar
354 longitudinal side of spreader bar
355 cross side of spreader bar
356 void for retainer pin 360 of spreader bar 350, the void defined within distal end 362 of the spreader bar
357 void for center pivot pin of spreader bar, the center pivot pin void defined within the proximal end 362 of the spreader bar
360 retainer pin of spreader bar
362 distal end of a spreader bar 350, may define a void 356 for retainer pin 360
363 proximal end of spreader bar 350, may define a void 357 for a center pivot pin 364
364 center pivot pin of spreader bar
370 spreader bar assembly, may include spreader bars 350 and lower end sections of push rod 345
400 crusher bar drive train
410 rod of crusher bar hydraulic system of crusher bar drive train 400
412 barrel of crusher bar hydraulic system of crusher bar drive train 400
415 hollow barrel connecting upper crush bars 425

417 pivot void defined within hollow barrel 415
419 pivot pin of hollow barrel
420 attachment nut
425 upper crush bar
426 upper horizontal member of upper crush bar 425
427 vertical member of upper crush bar 425
428 lower horizontal member of upper crush bar 425
430 inverted C channel attached to bottom of upper crush bar 425
432 horizontal member of inverted C channel
434 void for pushrod or pushrod void, the void defined within the horizontal member 432 of inverted C channel 430
436 vertical member of inverted C channel 430
438 skid surface attached to lower side of horizontal member 432 of inverted
C channel
440 track plate
442 upper surface of track plate 440
444 lower surface of track plate 440
450 track plate void defined between track plates 440 and inner area of inverted C channel 430
455 inner void area of inverted C channel 430, defined within the vertical members 436 and horizontal member 432 of the inverted C channel
500 halved bamboo stalk in an uncrushed state
520 halved bamboo stalk in a crushed or conditioned state
530 longitudinal break lines of a crushed bamboo stalk
600 level These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

Referring to FIG. 1, a disclosed embodiment 100 is shown having a support frame 200 that may comprise a plurality of upper horizontal members 210, a plurality of lower horizontal members 220, a plurality of vertical members 230. Various first movement or pushrod drive train components may include one or more power sources such as a hydraulic system or pushrod hydraulic system comprising a barrel 315 and rod 310 with the rod 310 in connection with one or more pushrods 345 by various means, including the rod 310 in attachment to a main rail 340 with the main rail in attachment to one or more cross bars 320 with the cross bars connected to one or more pushrods 345.

Various second movement or crusher bar drive train components may include a separate power source or hydraulic system and include one or more barrels 412, with each barrel having a rod 410. Each rod 410 may have a connection to an upper crush bar 425, such a connection may include the use of a pivot pin 419. The upper crush bar 425 may be attached to one or more inverted C channels 430 or similar structures. An inverted C channel 430 may be attached to one or more track plates with the track plates having lower horizontal surfaces 444. While in use, the lower horizontal surfaces 444 may press a workpiece upon a lower crush surface 240 and the lower crush surface 240 may be supported by one or more support channels 245.

Figure 2:
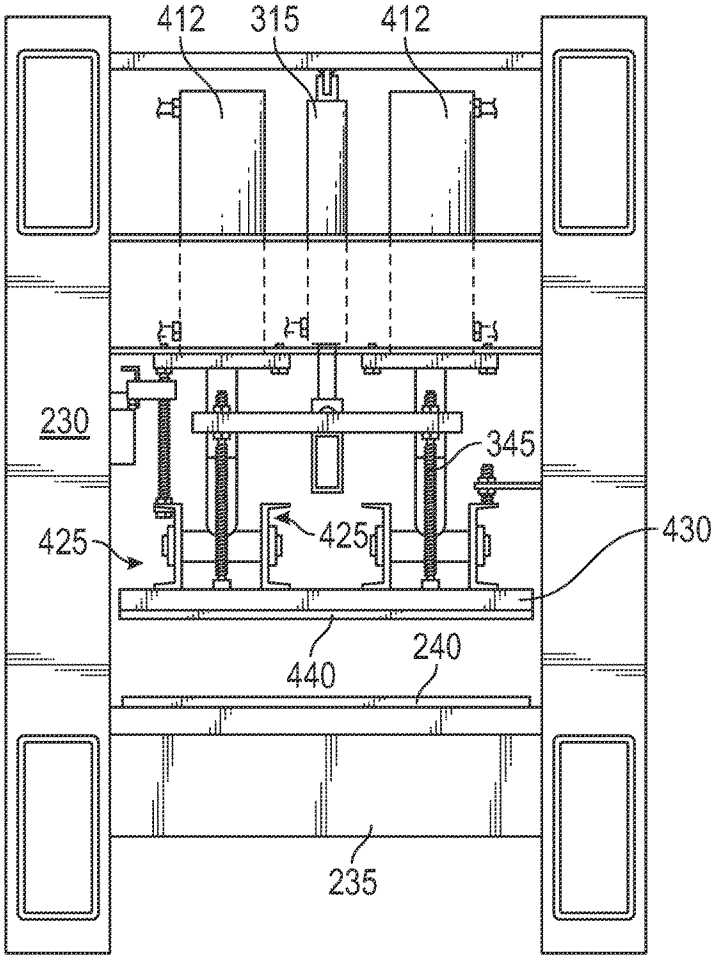
FIG. 2 depicts an end elevational view of a disclosed machine

FIG. 2 depicts an end view showing two barrels 412 for a crusher bar hydraulic system and one barrel 315 for a pushrod drive train. The upper crush bars 425 are shown in an up position, such that a workpiece could be placed upon the lower crush surface 240 and receive pressing from a track plate 440.

Figure 3:
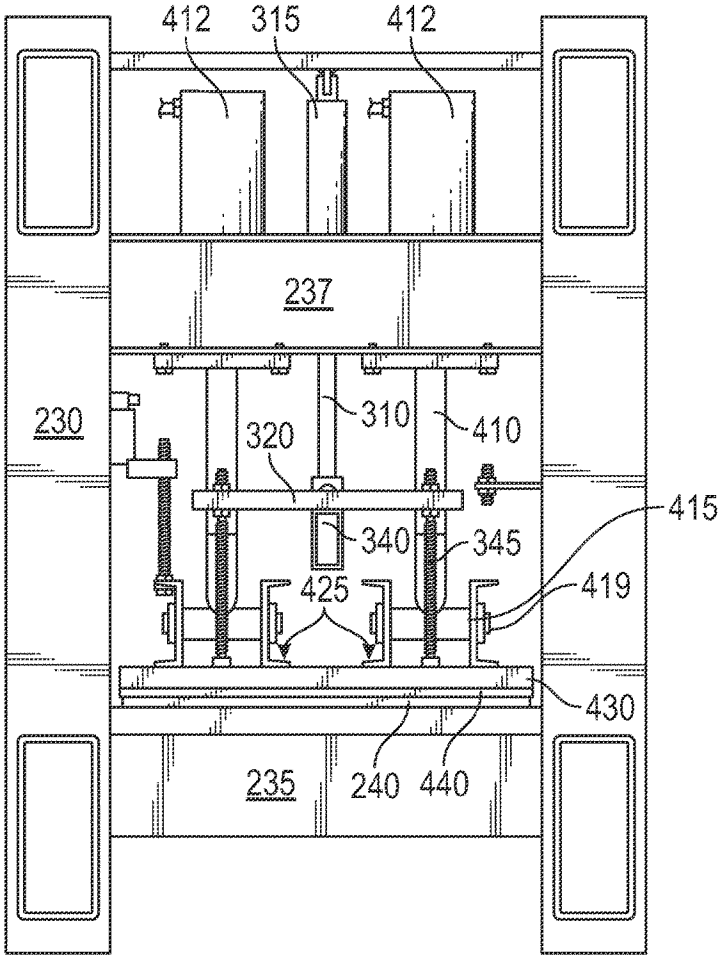
FIG. 3 depicts an end elevational view of a disclosed machine

FIG. 3 depicts FIG. 2 with a solid upper horizontal end member 237 and with the upper crush bars 325 and related components in a lowered position. While the transition between FIG. 2 and FIG. 3 fails to show the first or separate movement of the pushrod drive train, various pushrod drive train components are shown and may include a barrel 315 of a pushrod hydraulic system, a rod 310 (shown in an extended position), a main rail 340 supporting a cross bar 320 with the cross bar attached to one or more pushrods 345.

The second movement or crusher bar drive train may include a rod 410 (shown in an extended position), with the rod 410 attached to a hollow barrel 415 with the hollow barrel pivotally attached to two upper crush bars 425 by use of a pivot pin 419. The pivotal attachment of the hollow barrel 415 to the upper crush bars 425 provides a mechanical advantage of accommodating workpieces of non-uniform thicknesses or crush properties as the inverted C channel 430 and track plate 440 may pivot to comport with uneven material upon the lower crush surface 240.

Figure 4:
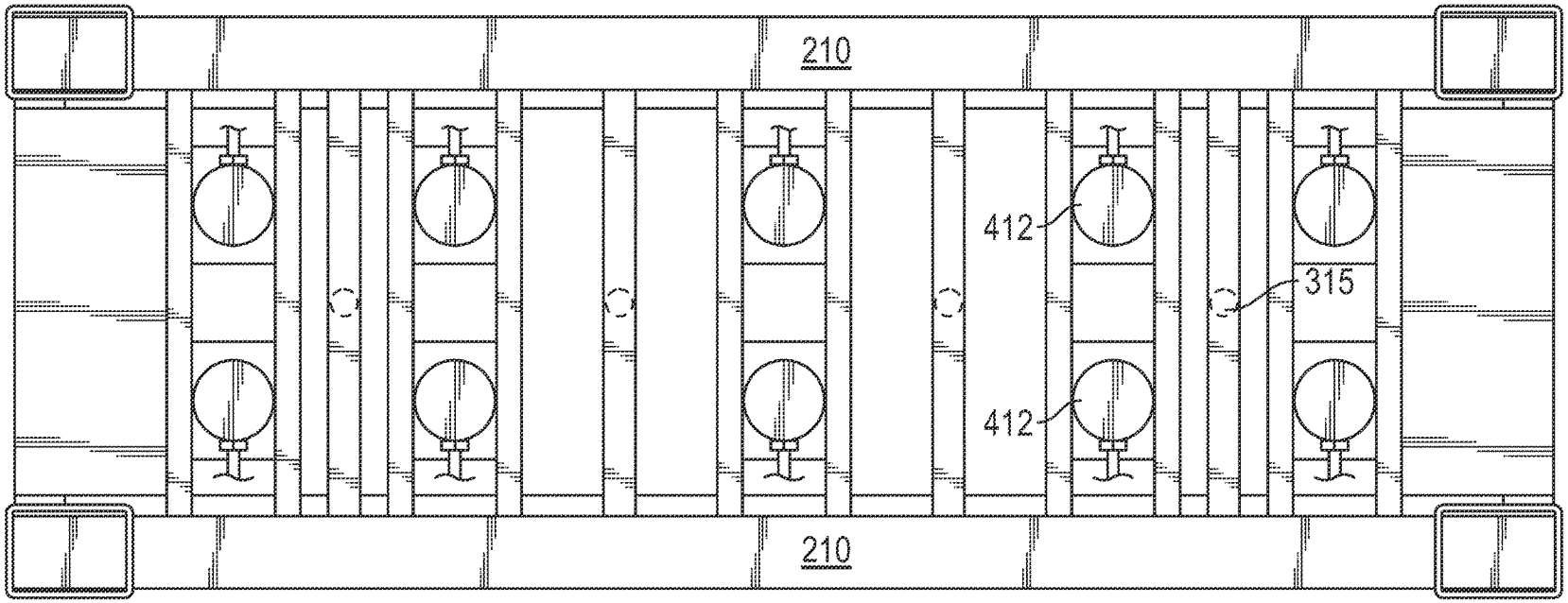
FIG. 4 depicts a top plan view of a disclosed machine

FIG. 4 depicts a top plan view of a disclosed machine which may include means of crushing two workpieces at one time and may include two rows of barrels 412 for a crusher bar hydraulic system and one row of barrels 315 to power the pushrod drive train. The disclosed configuration provides an adequate and efficient downward force for the pushrod drive train and a more powerful downward force for the crusher bar drive train. The disclosed two workpiece configuration achieves mechanical efficiency by use of just one row of barrels 315 to power two sets of pushrod drive trains for two separate workpieces.

Figure 5:
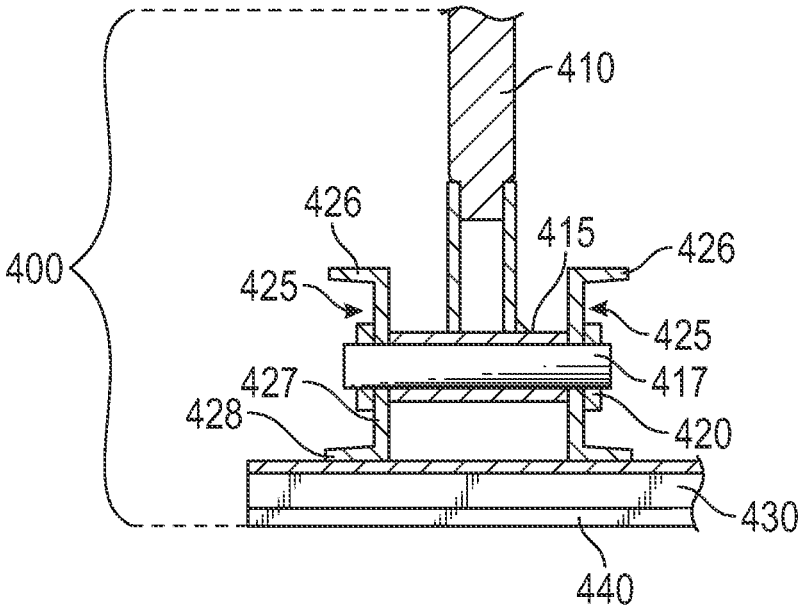
FIG. 5 depicts a sectional view of an upper crusher bar and related components

FIG. 5 depicts crusher bar drive train components 400 which may include a rod 410 powered by an hydraulic system or other power source, the rod 410 may be attached to a hollow barrel 415, the hollow barrel 415 may be pivotally or hingedly attached to a pair of upper crush bars 425. The hollow barrel 415 may define a pivot void 417 and the pivot void 417 may retain a pivot pin. An attachment nut 420 fastened to the outside surfaces of the upper crush bars 425 may assist in rotational movement of the crush bars. A crush bar 425 may comprise an upper horizontal member 426 attached to a vertical member 427, with the vertical member 427 attached to a lower horizontal member 428. The lower horizontal member 428 may be attached to an inverted C channel 430 and the inverted C channel 430 may be attached to one or more track plates 440.

Figure 6:
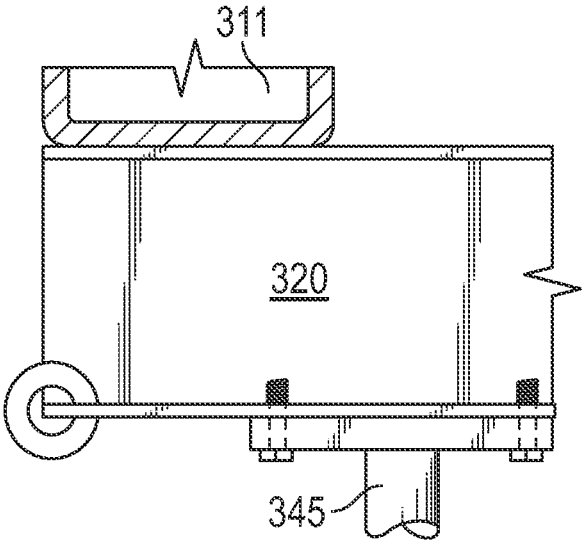
FIG. 6 depicts a sectional view of a cross bar and related components

FIG. 6 depicts a first movement or pushrod drive train components that may include a cross bar 320 attached to a pushrod 345 and a connection component 311, with the connection component sometimes connected to a rod of a pushrod drive train.

Figure 7:
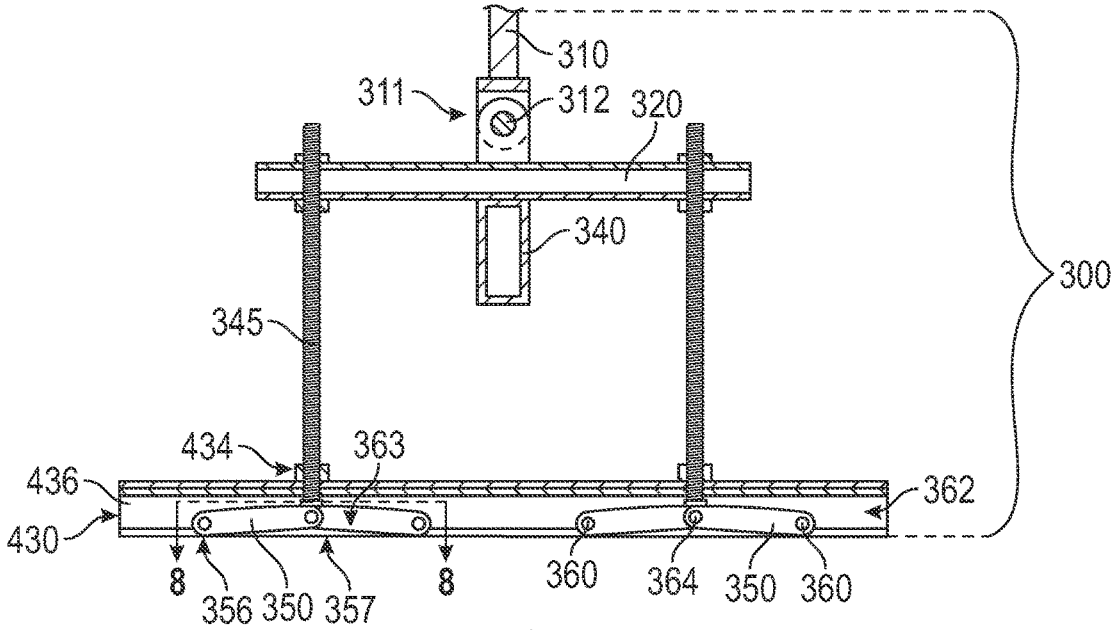
FIG. 7 depicts a sectional view of various components of a pushrod drive train

FIG. 7 depicts a sectional view of various first movement or pushrod drive train components 300 that may include a rod 310 rigidly or pivotally attached to a connection component 311, with a hinge pin 312 sometimes used to pivotally connect the rod 310 to the connection component 311. The connection component may be attached to a main rail 340 and the main rail 340 may be attached to one or more cross bars 320. Each cross bar may be connected to one or more pushrods 345. Each pushrod 345 may pass through pushrod void 434, the void defined within an inverted C channel 430. The lower end of the pushrod 345 may comprise a flat distal section that may be hingedly attached to two spreader bars 350. Each spreader bar 350 may have a proximal end 363, near the pushrod and center pivot pin 364 and each spreader bar may have an outer or distal end 362 near a retainer pin 360. A retainer pin 360 overcomes shortfalls in the art by retaining a spreader bar within an inverted C channel 430 and track plate 440. Retaining the distal ends of the spreader bars within a track plate void (450 as shown in FIG. 8) provides a mechanical advantage in forcing the spreader bars to open the walls of halved bamboo stalk or similar workpiece.

Figure 8:
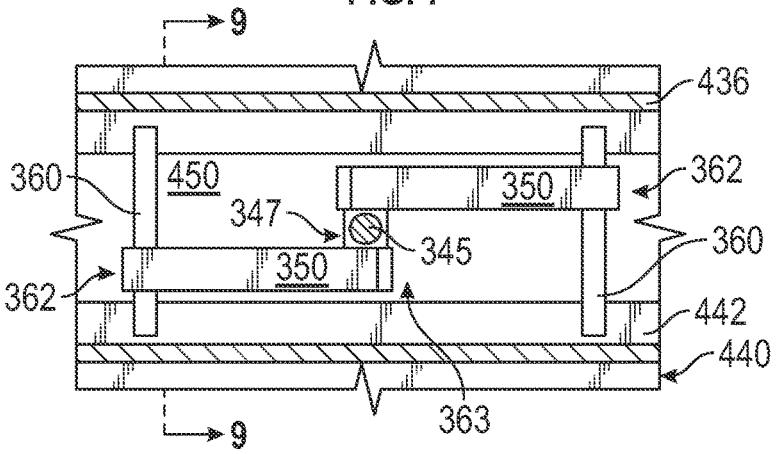
FIG. 8 depicts a top plan view of a spreader bar assembly

FIG. 8 depicts a sectional and plan view of a spreader bar assembly shown in FIG. 7. A track plate void 450 may be defined within the inner confines of an inverted C channel and the upper surface 442 of a track plate 440. Each spreader bar 350 may comprise a distal end 362 containing a retainer pin 360. Each spreader bar 350 may have a proximal end 363 near a hingedly attached pushrod 345, with the pushrod sometimes having a flat distal section 347 having flat sides to accommodate movement with the spreader bars.

Figure 9:
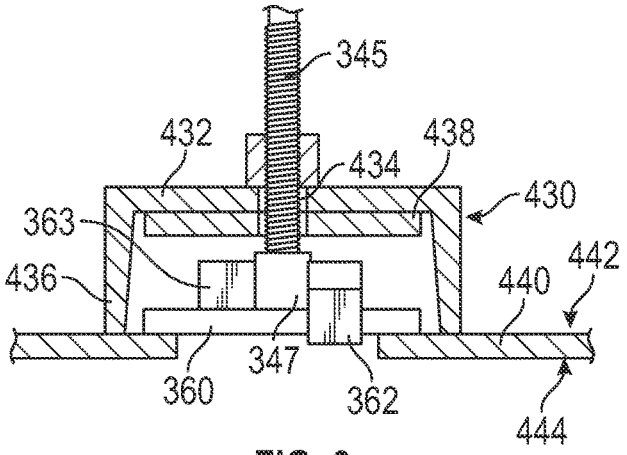
FIG. 9 depicts a sectional view of a spreader bar assembly

FIG. 9 depicts a sectional and elevational view of the spreader bar assembly of FIG. 8 and shows a skid surface 438 attached below the inferior or lower surface of the horizontal member 432 of the inverted C channel 430. A skid surface 438 provides a mechanical advantage of sometimes being comprised of a different material from the inverted C channel. Moreover, a separate skid surface 438 may be easier to replace as opposed to an entire inverted C channel. Further mechanical advantage is obtained by the cambered edge of a spreader bar (352 FIG. 25) pressing or rotation upon a skid surface.

The foreground of FIG. 9 depicts a distal end 362 of a spreader. The background of FIG. 9 depicts a proximal end 363 of a spreader bar adjacent to the distal end 347 of the pushrod 345. Each track plate 440 may comprise an upper surface 442 to retain the retainer pins and for attachment to the inverted C channels. The lower surface 444 of the track plates may act as a planar crushing surface upon a workpiece. Having the track plates retain the retailing pins and crush the workpiece provides a mechanical advantage in keeping the spreader bars exceptionally close to the crush surface such that a workpiece is moved by both horizontal and vertical forces.

Figure 10:
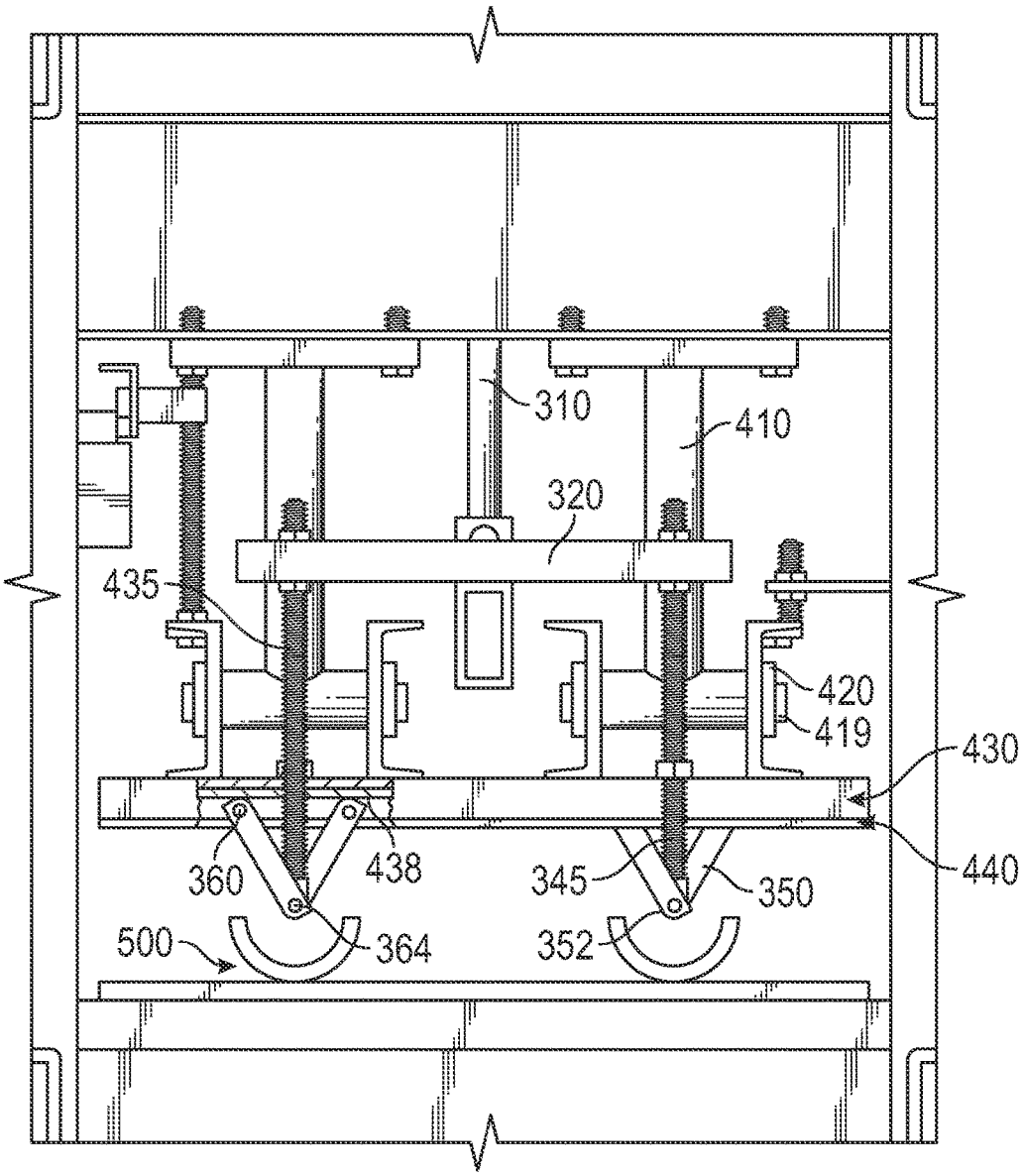
FIG. 10 depicts a partial sectional view of push rod assembly components

FIG. 10 depicts a disclosed machine in an up position with a halved bamboo stalk 500 in an uncrushed state. The left hand side of FIG. 10 depicts a sectional view of spreader bars contained within an inverted C channel 430 and track plate 440. A mechanical advantage is obtained by the cambered edge 352 of a spreader bar 350 pressing upon the inside surface of a workpiece such that the workpiece is not cut and such that the spreader bar rolls upon the workpiece.

Figure 11:
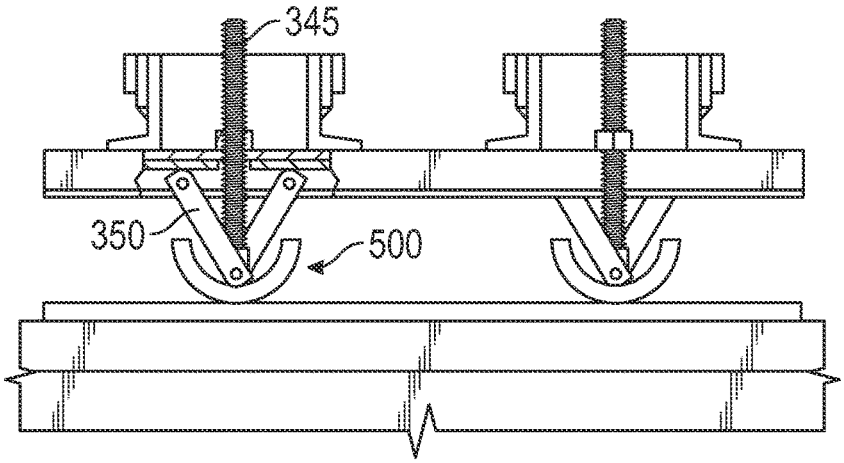
FIG. 11 depicts a partial sectional view of a spreader bar assembly and related components

FIG. 11 depicts the completion of a first movement wherein the spreader bars 350 and pushrod 345 have retained or pinned down a workpiece.

Figure 12:
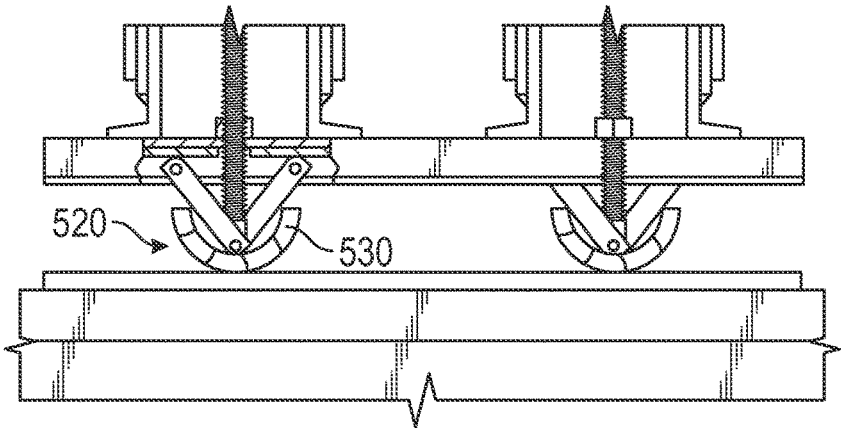
FIG. 12 depicts a partial sectional view of a spreader bar assembly and related components

FIG. 12 depicts a second movement in progress wherein the spreader bars have spread apart a workpiece 520 resulting in desired longitudinal cracks or scoring 530.

Figure 13:
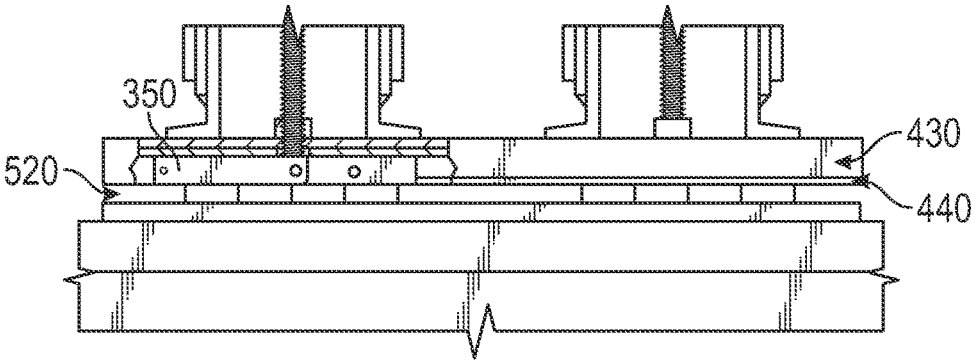
FIG. 13 depicts a partial sectional view of a spreader bar assembly in a flattened position

FIG. 13 depicts the completion of a second movement wherein the spreader bars 350 are fully retracted into the inverted C channel 430. The full retraction or horizontal position of the spreader bars 350 in the finished position prevents the spreader bars from cutting into the workpiece and allows the planar surfaces of the track plates 440 to smoothly flatten the workpiece.

Figure 14:
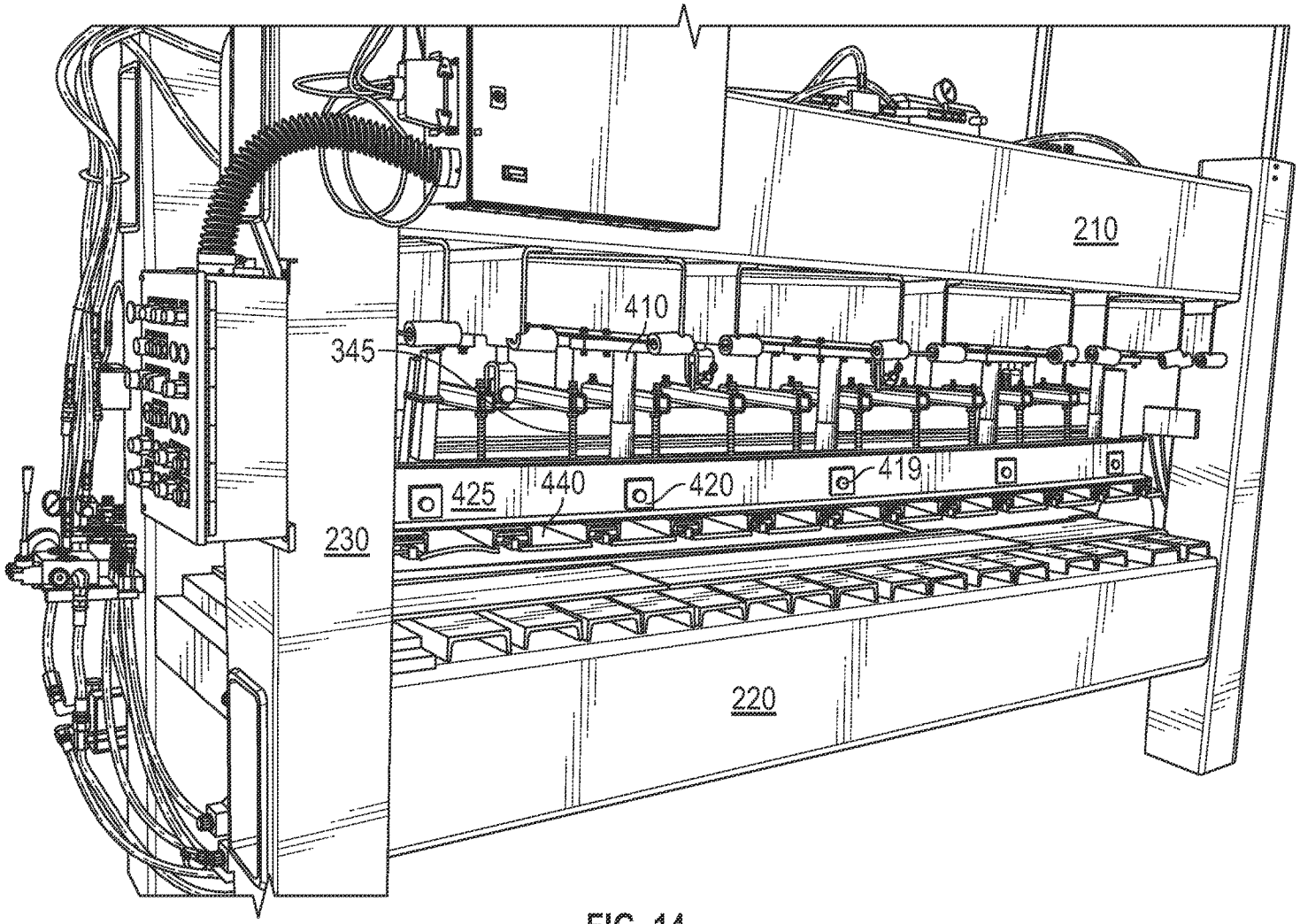
FIG. 14 depicts a side and end perspective view of a disclosed machine

FIG. 14 depicts a perspective view of a disclosed machine ready to accept a workpiece.

Figure 15:
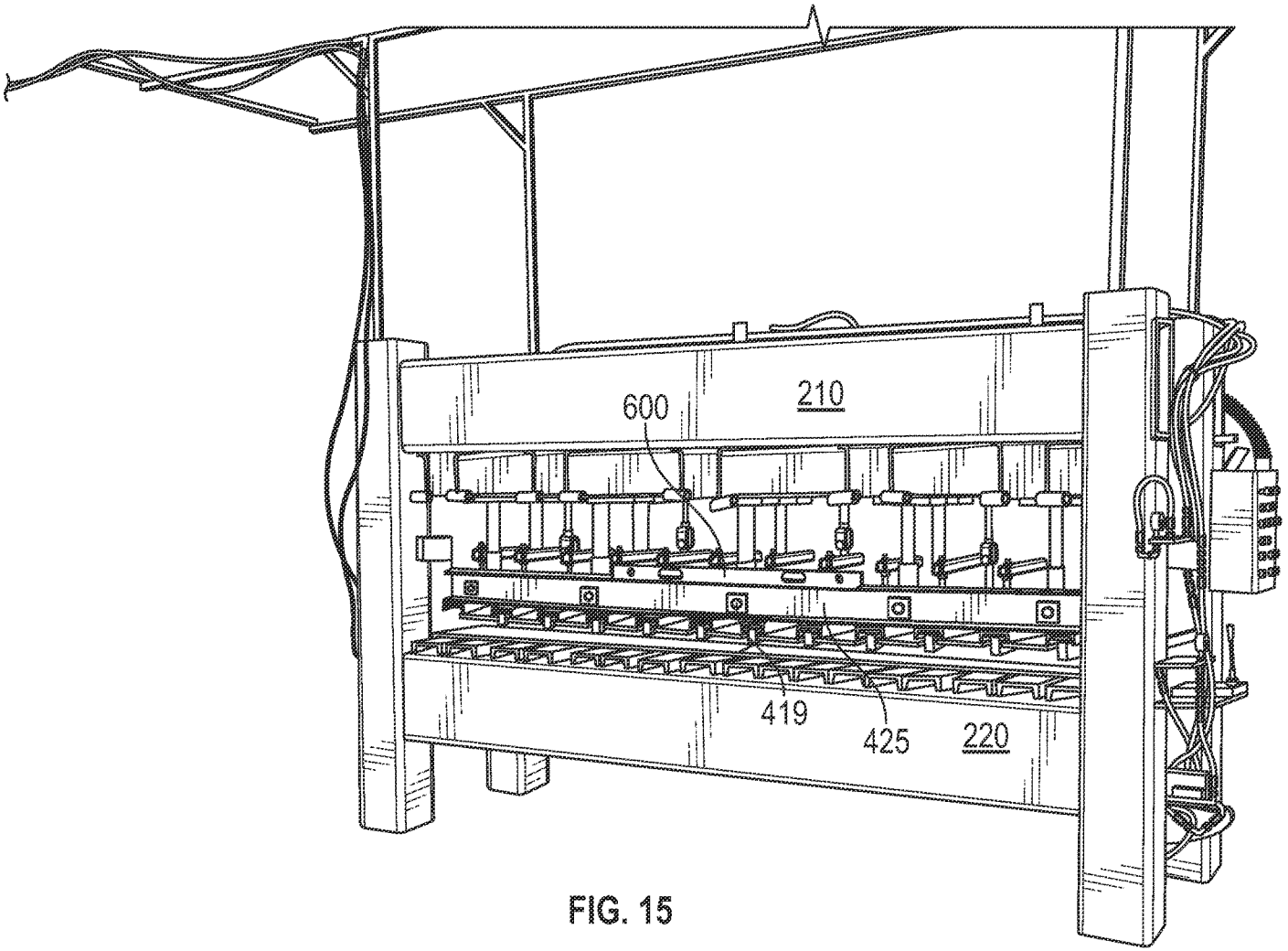
FIG. 15 depicts a side and end perspective view of a disclosed machine

FIG. 15 depicts a perspective view of a disclosed machine in a down position and with a level 600 placed on top of an upper crush bar 425. Due to the pivot pin 419 and related pivotal attachment components shown in FIG. 5, the upper crush bar 425 is allowed to be out of level to accommodate workpieces of non-uniform thickness. The pivot properties of the upper crush bar attachment system prevent over crushing in thick areas of a workpiece. A level 600 may be used to check the positioning of an upper crush bar.

Figure 16:
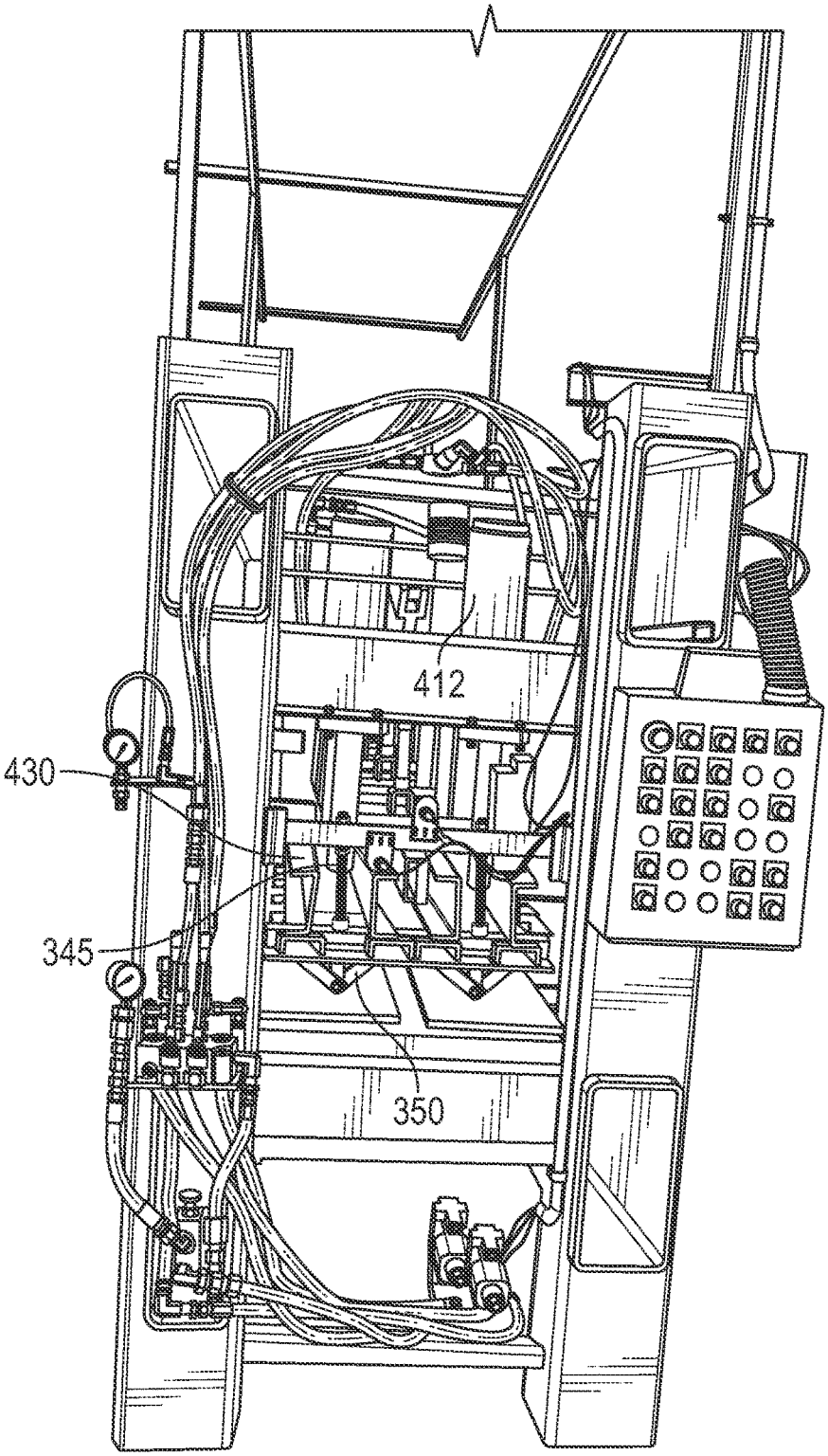
FIG. 16 depicts an end perspective view of a disclosed machine

FIG. 16 depicts a perspective end view of a disclosed machine and shows two rows of spreader bars 350 configured to spread two workpieces in the same pressing.

Figure 17:
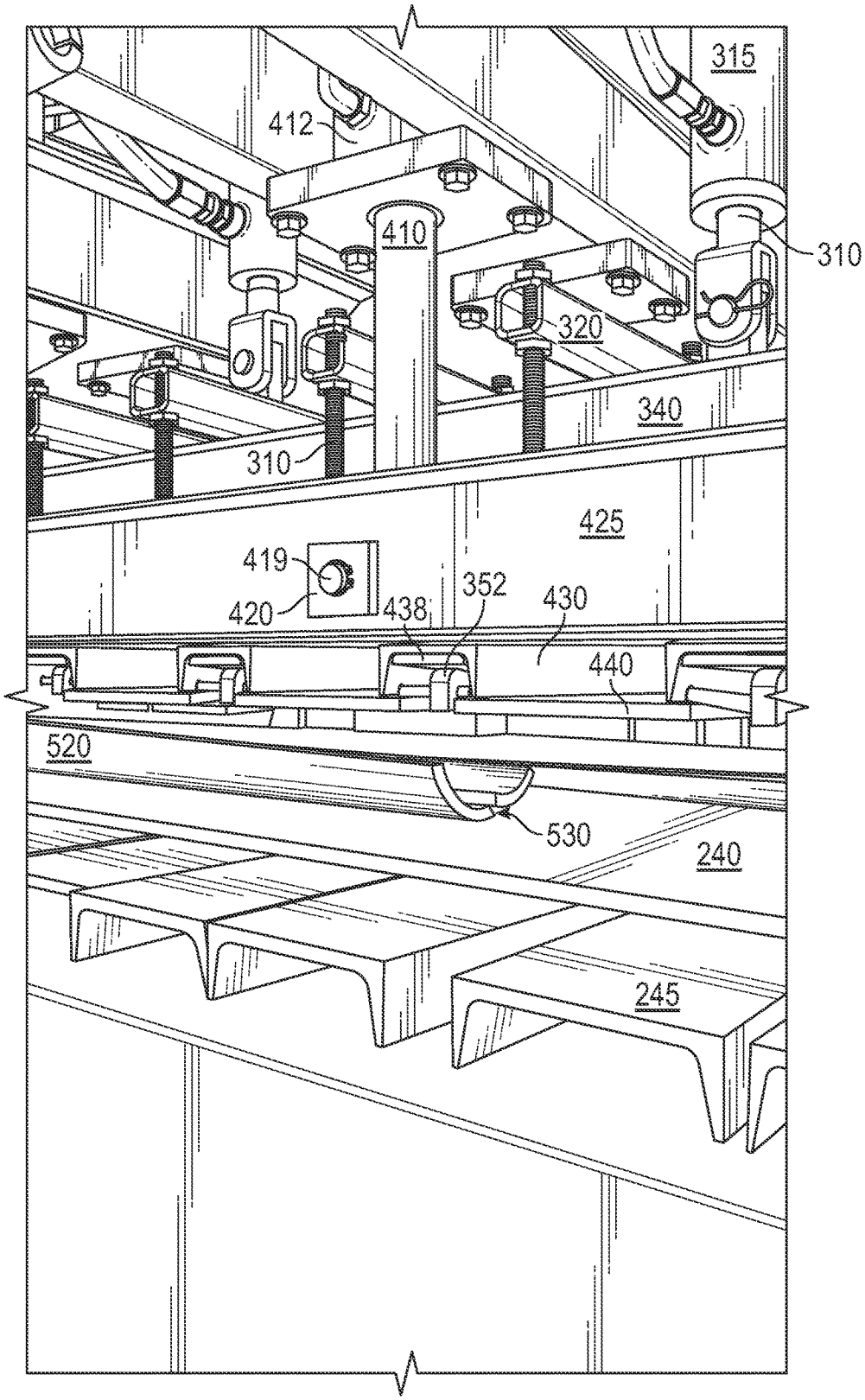
FIG. 17 depicts a side perspective view of a disclosed machine

FIG. 17 depicts a perspective view of a conditioned or pressed workpiece 520 having a desired longitudinal crack or score line 530.

Figure 19:
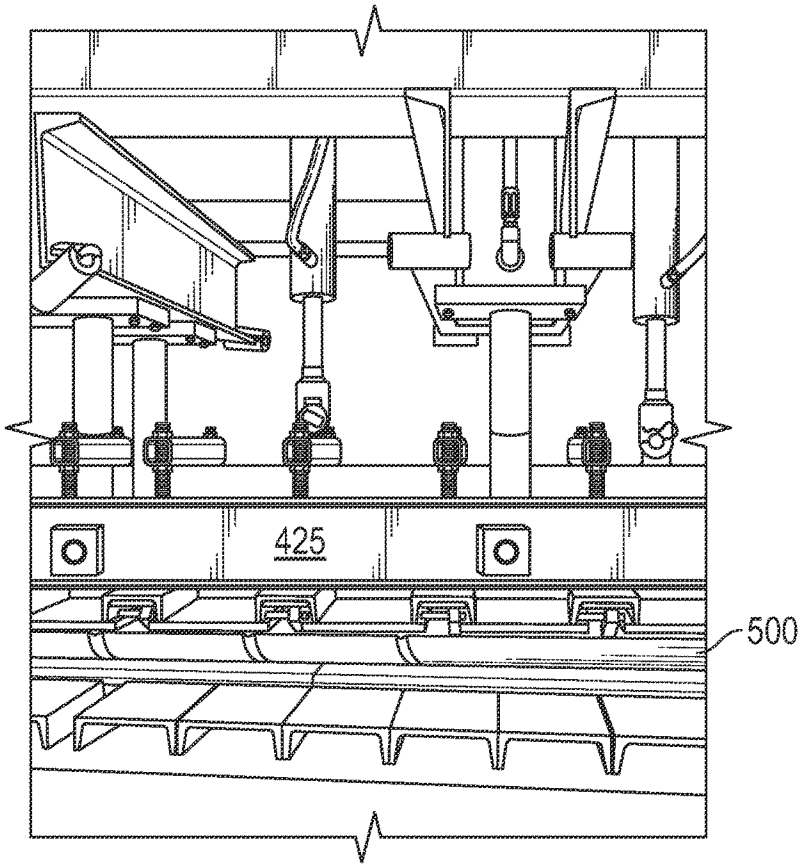
FIG. 19 depicts a side perspective view of a disclosed machine
Figure 18:
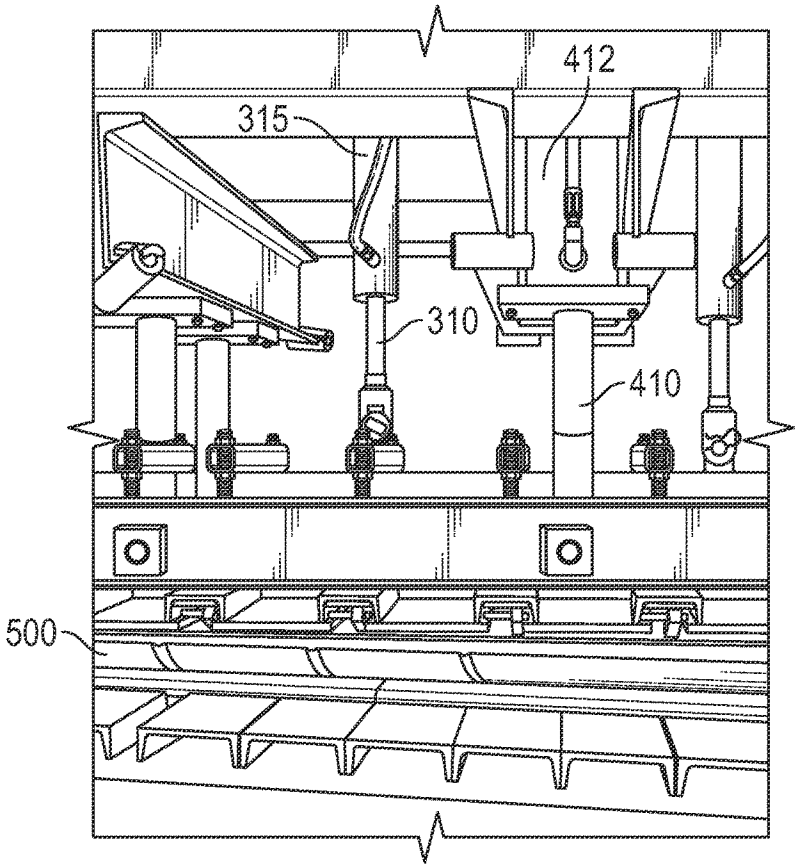
FIG. 18 depicts a side perspective view of a disclosed machine

FIG. 18 and FIG. 19 depict a workpiece 500 and various machine components.

Figure 21:
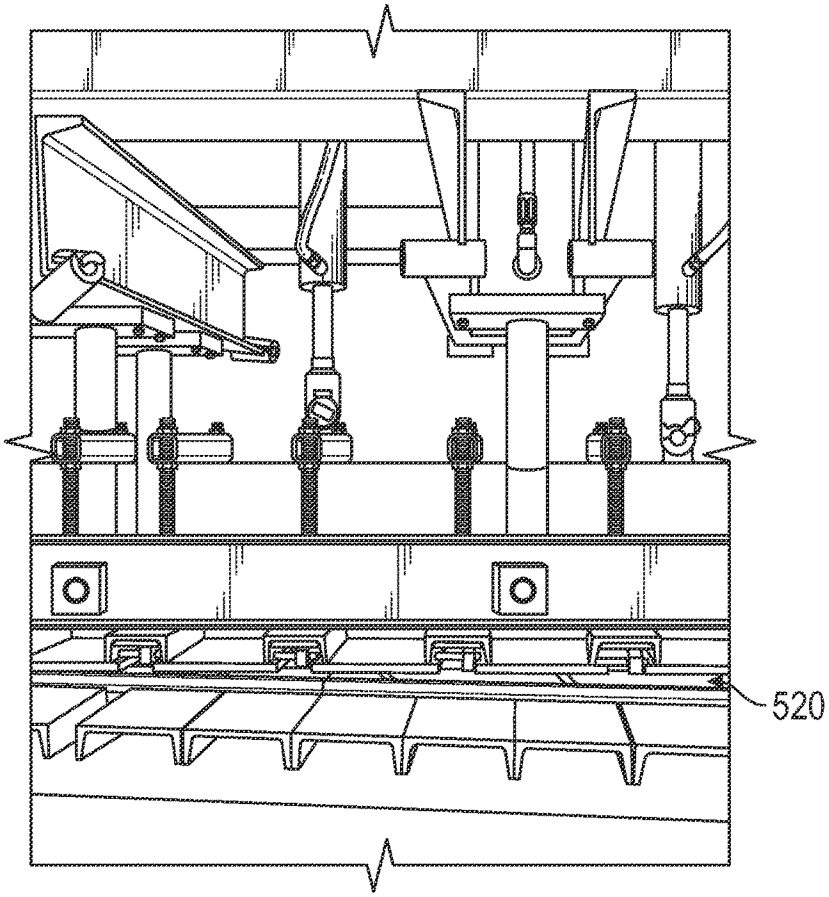
FIG. 21 depicts a side perspective view of a disclosed machine with a workpiece in a flattened or near flattened position
Figure 20:
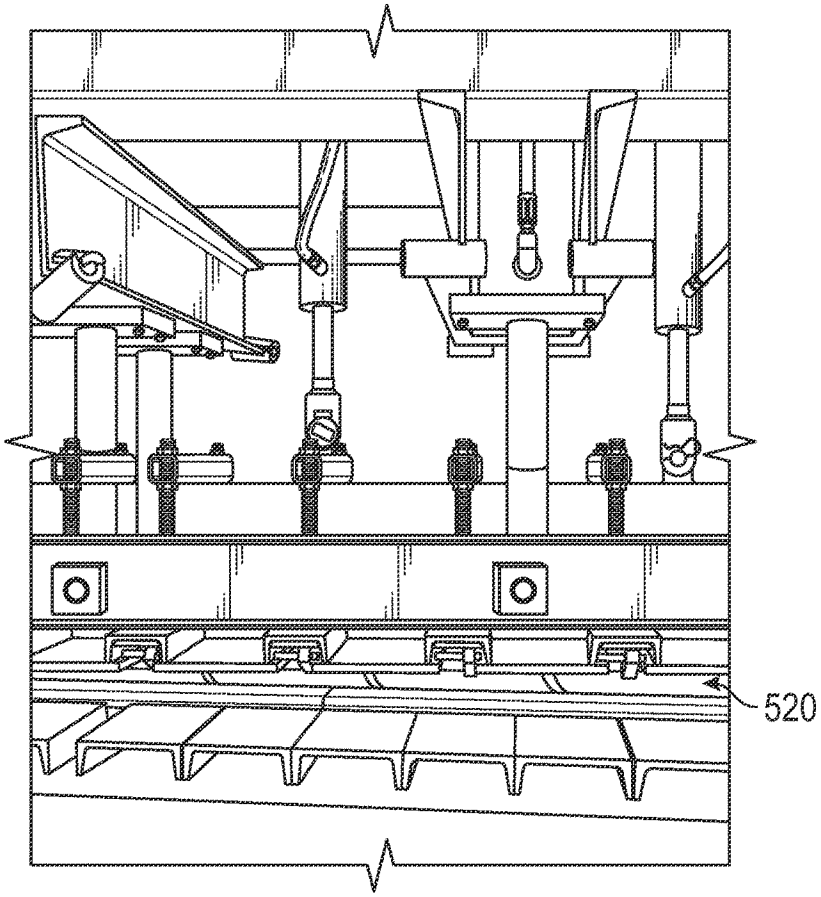
FIG. 20 depicts a side perspective view of a disclosed machine

FIG. 20 and FIG. 21 depicts a workpiece being crushed or flattened.

Figure 22:
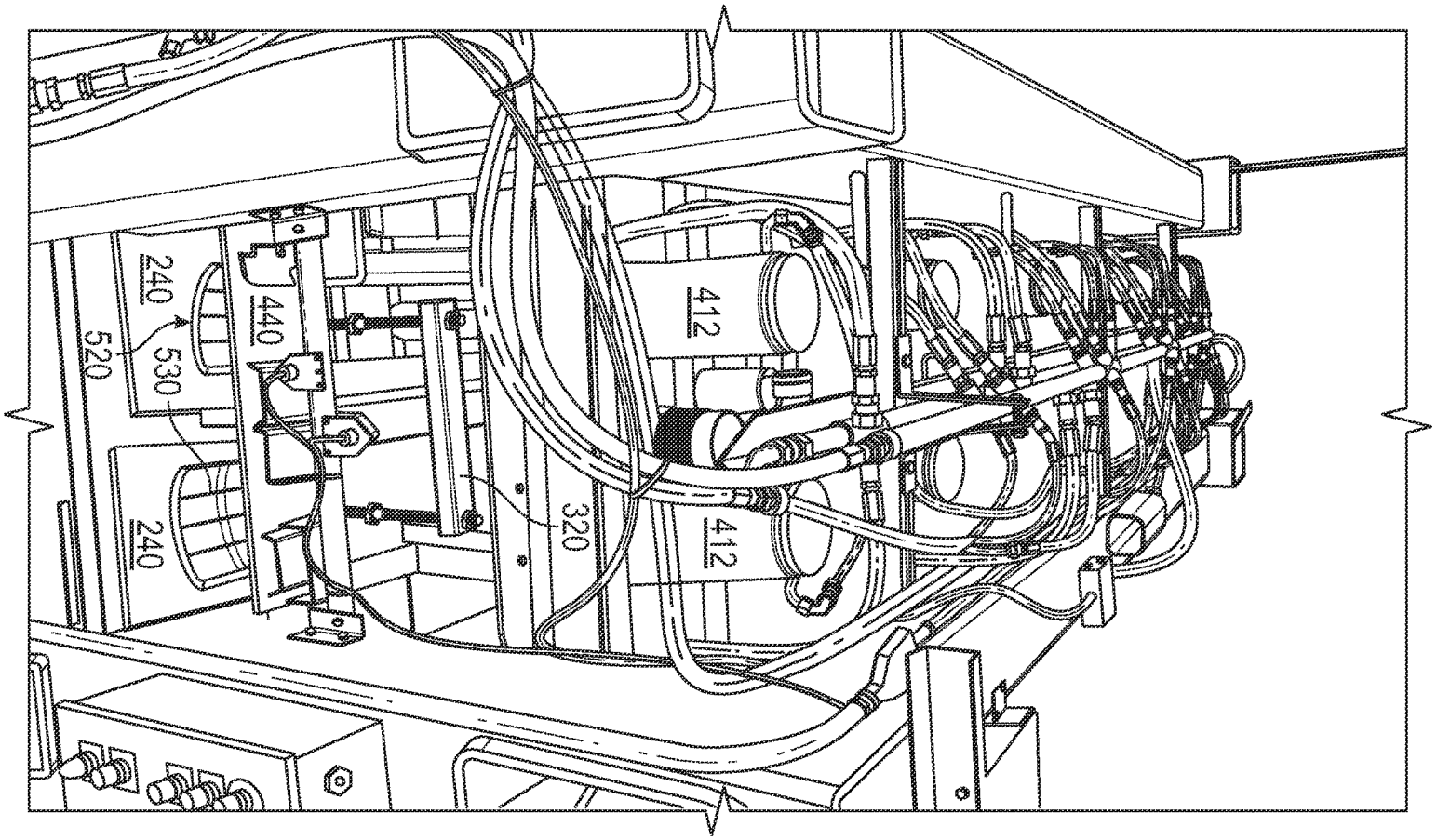
FIG. 22 is a top perspective view of a disclosed machine

FIG. 22 depicts two flattened workpieces 530 pressed upon two lower crush surfaces 240 or bottom plates.

Figure 23:
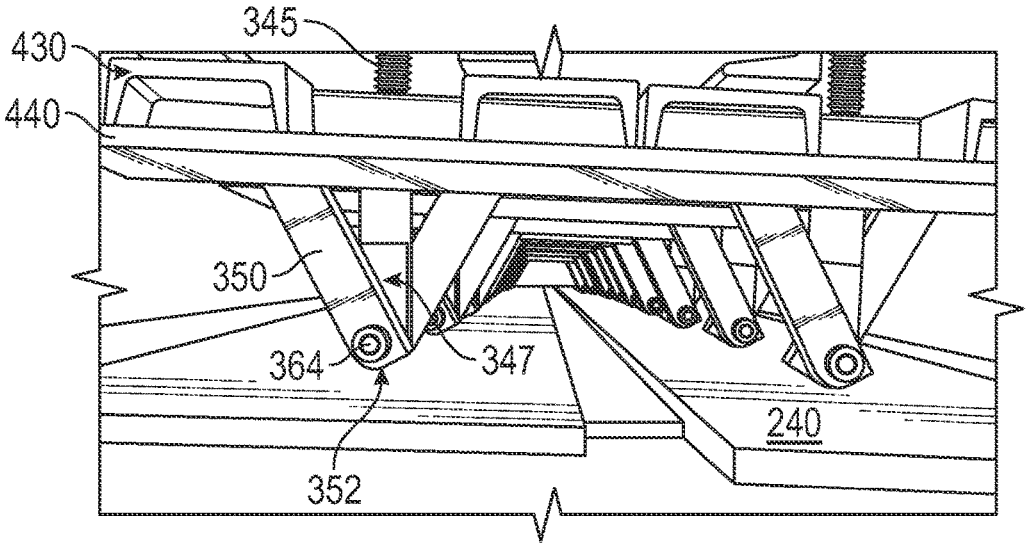
FIG. 23 is a perspective view of several spreader bar assemblies

FIG. 23 depicts two rows of spreader bars in a down position or completed first movement without a workpiece.

Figure 24:
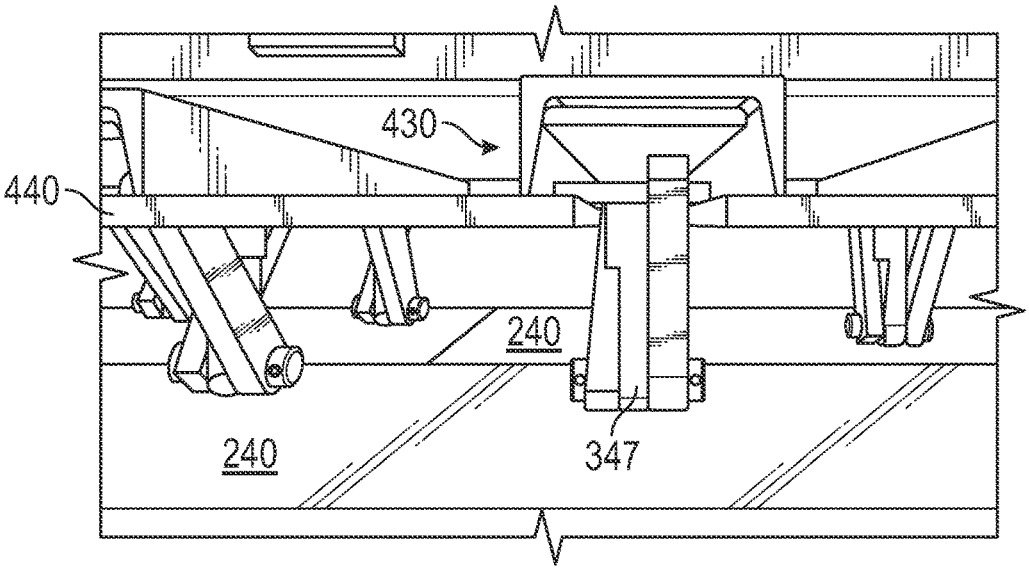
FIG. 24 is a perspective view of several spreader bar assemblies

FIG. 24 depicts two rows of spreader bars in a down position or completed first movement without a workpiece.

Figure 25:
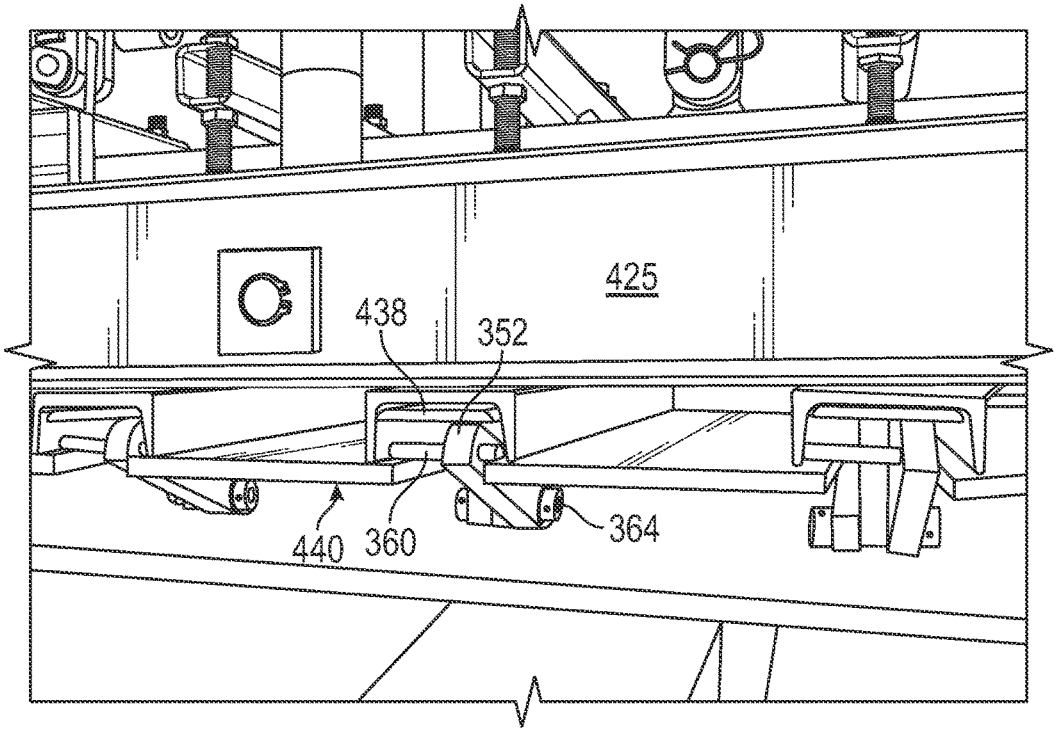
FIG. 25 is a perspective view of several spreader bar assemblies

FIG. 25 depicts a cambered edge 352 of a spreader bar in contact with a skid surface 438. The cambered edge 352 of the spreader bar in contact with the skid surface provides a mechanical advantage in that the cambered edge 352 will not wear down over time such as a normal edge or ninety degree edge.

Figure 26:
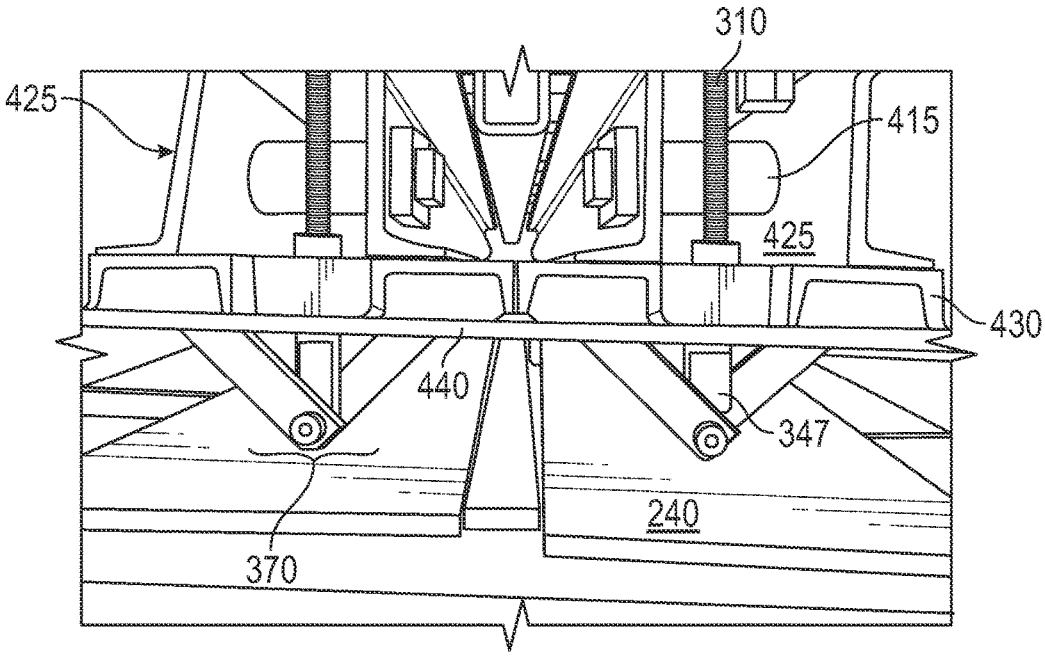
FIG. 26 is a perspective view of several spreader bar assemblies

FIG. 26 depicts two rows of spreader bar assemblies 370 which may comprise two spreader bars and the end area or distal end of a pushrod. The distal end of a pushrod may include a flat distal section 347.

Figure 27:
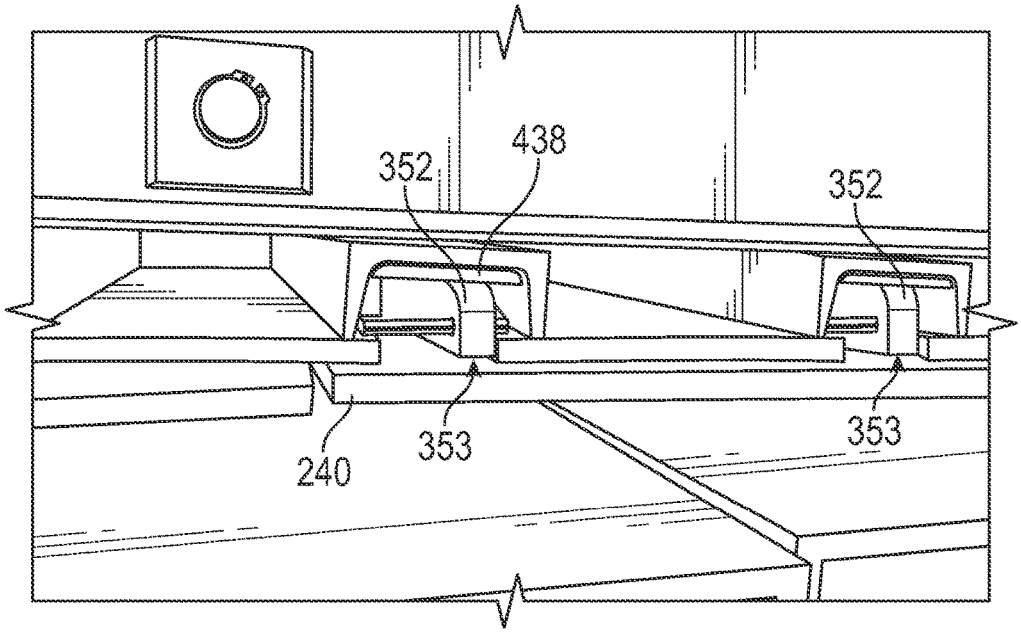
FIG. 27 is a perspective view of several spreader bar assemblies in a flattened or near flattened position

FIG. 27 depicts a distal end of a spreader bar having a normal edge 353 near a lower crush surface 240. A normal edge 353 upon a lower crush surface 240 provides a mechanical advantage in keeping the downward moving components planar similar to the planar surface of the track plates 440. FIG. 27 further shows the cambered edge 352 of a spreader bar in contact with a skid surface 438.

Figure 28:
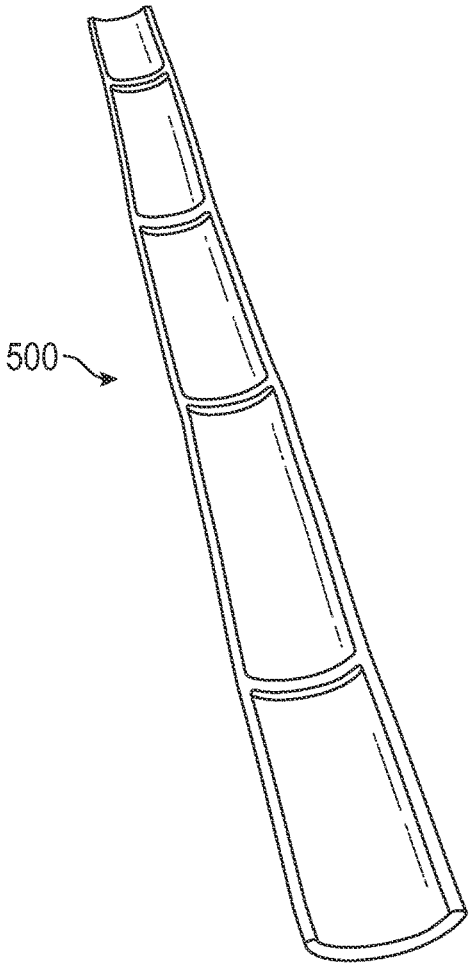
FIG. 28 is a perspective view of a halved bamboo stalk in a natural state

FIG. 28 depicts a halved bamboo stalk.

Figure 29:
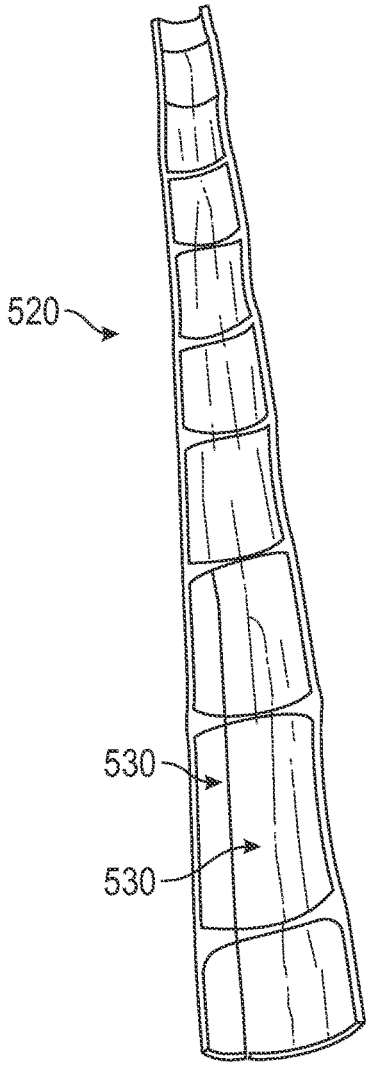
FIG. 29 is a perspective view of a halved bamboo stalk after being flattened
Figure 30:
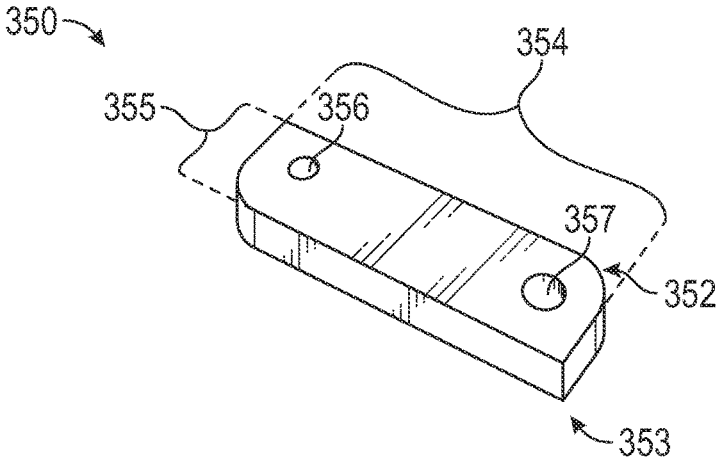
FIG. 30 is a perspective view of a spreader bar

FIG. 29 depicts a crushed, flattened or conditioned bamboo stalk or similar workpiece having longitudinal break lines 530 or score lines. After crushing, a stalk may coil back into a curved position, but the stalk is easily reflattened or repositioned for further processing. Unlike the methods or machines of the prior art, a stalk crushed by a disclosed embodiment may be used in total, with no parts cut away.

Disclosed embodiments overcome shortfalls in the art by eschewing the use of chemicals or solvents to flattened workpieces.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

Items

Item 1. A machine 100 for pressing halved bamboo stalks 500 and similar workpieces, the machine comprising:

a) a pushrod drive train 300 comprising:

a pushrod 345 having a proximal end and a distal end, with the distal end pivotally connected to two spreader bars 350 with each spreader bar comprising a proximal end 363 defining a center pivot pin void 357 and each spreader bar comprising a distal end 362 defining a retainer pin void 356 with each retainer pin void containing a retainer pin 360;

b) a crusher bar drive train 400 comprising:

a crusher bar drive train rod 410 attached to an inverted C channel 430, the inverted C channel comprising two vertical members 436 with each vertical member comprising a topside and a bottom side with the two top sides of the two vertical members attached to a horizontal member 432 with the horizontal member defining a pushrod void 434, the pushrod void mated to the pushrod, a track plate 440 attached to the bottom side of each vertical member of the inverted C Channel, each track plate comprising an upper planar surface 442 and a lower planar surface, with the upper planar surface of each track plate supporting the retainer pin of each spreader bar.

Item 2. The machine of 1 wherein the distal end of the pushrod defines a pivot pin void containing a center pivot pin 360 and the center pivot pin mates with the center pivot pin voids of each spreader bar.

Item 3. The machine of 1 wherein the distal end of the pushrod comprises a flat section 347.

Item 4. The machine of 1 wherein the pushrod is attached to a pushrod drive train rod 310.

Item 5. The machine of 4 wherein the pushrod drive train rod is attached to a power system providing vertical movement.

Item 6. The machine of 4 wherein the pushrod drive train rod is attached to a hydraulic power system providing vertical movement.

Item 7. The machine of 1 wherein the crusher bar drive train rod is attached to a power system providing vertical movement.

Item 8. The machine of 1 wherein the crusher bar drive train rod is attached to a hydraulic power system providing vertical movement.

Item 9. The machine of 1 wherein the crusher bar drive train rod is attached to a hollow barrel 415 and the hollow barrel is attached to two upper crush bars 425 and each upper crush bar comprising a vertical member 427 attached to a lower horizontal member 428 with each lower horizontal member attached to the inverted C channel.

Item 10. The machine of 9 wherein the hollow barrel is pivotally attached to the two upper crush bars by use of a pivot void 417 defined within the hollow barrel and a pivot pin 419 matted into the pivot void.

Item 11. The machine of 1 wherein each spreader bar comprises a two normal edges 353 and two cambered edges 352.

Item 12. The machine of 1 comprising a plurality of pushrod drive trains wherein each proximal end of each pushrod is attached to a cross bar 320 and each cross bar is attached to a main rail 340 and each main rail is attached to a pushrod drive train rod and wherein the plurality of pushrod drive trains are configured to secure a workpiece along a center line of the workpiece.

Item 13. The machine of 11 further comprising a plurality of crusher bar drive trains.

Item 14. A method of crushing a halved bamboo stalk and similar workpieces, the method comprising the steps of:

a) a first movement securing a workpiece to a lower crush surface 240 by use of a pushrod drive train 300, the pushrod drive train comprising spreader bar assembly 370, the spreader bar assembly comprising two spreader bars 350 and a flat distal section 347 of a pushrod 345, wherein the two spreader bars each comprise proximal ends pivotally connected to the flat distal section of the pushrod and the flat distal section and the proximal ends of the pushrods pin down the work piece;

b) a second movement spreading apart walls of the workpiece by use of distal ends of the spreader bars with the distal ends of the spreader bars moved outwardly by use of a crusher bar drive train 400 with the crusher bar drive train comprising an inverted C channel 430 attached to two track plates 440 with the two track plates retaining two retainer pins 360 attached to the distal ends of the spreader bars wherein downward movement of the inverted C channel urges the spreader bars outwardly.

Item 15. The method further including a continuation of the second movement executing the step of flattening the workpiece by use of lower planar surfaces of the track plates as the inverted C channel is moved downwardly.

Item 16. The method wherein the first movement starts with the pushrod drive train in a raised position, allowing for the placement of a work piece upon the lower crush surface and wherein the first movement concludes with the pushrod in a lowered position and the pushrod remaining stationary during the second movement.

What is claimed is:

1. A machine for pressing halved bamboo stalks and similar workpieces, the machine comprising:

a) a pushrod drive train comprising:

a pushrod having a proximal end and a distal end, with the distal end pivotally connected to two spreader bars with each spreader bar comprising a proximal end defining a center pivot pin void and each spreader bar comprising a distal end defining a retainer pin void with each retainer pin void containing a retainer pin;

b) a crusher bar drive train comprising:

a crusher bar drive train rod attached to an inverted C channel, the inverted C channel comprising two vertical members with each vertical member comprising a topside and a bottom side with the two top sides of the two vertical members attached to a horizontal member with the horizontal member defining a pushrod void, the pushrod void mated to the pushrod, a track plate attached to the bottom side of each vertical member of the inverted C channel, each track plate comprising an upper planar surface and a lower planar surface, with the upper planar surface of each track plate supporting the retainer pin of each spreader bar, wherein the distal ends of the spreader bars move outwardly to spread apart curved walls of the workpiece, and wherein the lower planar surface of the track plate moves downwardly to flatten the previously spread apart walls of the workpiece.

2. The machine of claim 1 wherein the distal end of the pushrod defines a pivot pin void containing a center pivot pin and the center pivot pin mates with the center pivot pin voids of each spreader bar.

3. The machine of claim 1 wherein the distal end of the pushrod comprises a flat section.

4. The machine of claim 1 wherein the pushrod is attached to a pushrod drive train rod.

5. The machine of claim 4 wherein the pushrod drive train rod is attached to a power system providing vertical movement.

6. The machine of claim 4 wherein the pushrod drive train rod is attached to a hydraulic power system providing vertical movement.

7. The machine of claim 1 wherein the crusher bar drive train rod is attached to a power system providing vertical movement.

8. The machine of claim 1 wherein the crusher bar drive train rod is attached to a hydraulic power system providing vertical movement.

9. The machine of claim 1 wherein the crusher bar drive train rod is attached to a hollow barrel and the hollow barrel is attached to two upper crush bars and each upper crush bar comprising a vertical member attached to a lower horizontal member with each lower horizontal member attached to the inverted C channel.

10. The machine of claim 9 wherein the hollow barrel is pivotally attached to the two upper crush bars by use of a pivot void defined within the hollow barrel and a pivot pin matted into the pivot void.

11. The machine of claim 1 wherein each spreader bar comprises a two normal edges and two cambered edges.

12. The machine of claim 1 comprising a plurality of pushrod drive trains wherein each proximal end of each pushrod is attached to a cross bar and each cross bar is attached to a main rail and each main rail is attached to a pushrod drive train rod and wherein the plurality of pushrod drive trains are configured to secure a workpiece along a center line of the workpiece.

13. The machine of claim 11 further comprising a plurality of crusher bar drive trains.

* * * * *